US011578865B2

(12) United States Patent
Zink et al.

(10) Patent No.: US 11,578,865 B2
(45) Date of Patent: Feb. 14, 2023

(54) PLUGGING RESISTANT FREE-JET BURNER AND METHOD

(71) Applicant: ZEECO, INC., Broken Arrow, OK (US)

(72) Inventors: Darton J. Zink, Tulsa, OK (US); Rex K. Isaacs, Collinsville, OK (US); John Petersen, Pawnee, OK (US); Tim Kirk, Morris, OK (US); Austin White, Tulsa, OK (US)

( * ) Notice: Subject to any disclaimer, the term of this patent is extended or adjusted under 35 U.S.C. 154(b) by 277 days.

(21) Appl. No.: 16/875,286

(22) Filed: May 15, 2020

(65) Prior Publication Data

US 2021/0356119 A1 Nov. 18, 2021

(51) Int. Cl.
*F23C 9/08* (2006.01)
*F23C 9/00* (2006.01)

(52) U.S. Cl.
CPC ..... *F23C 9/006* (2013.01); *F23C 9/08* (2013.01)

(58) Field of Classification Search
CPC ..... F23C 9/006; F23C 9/08; F23C 2201/301; F23C 2900/06043; F23C 7/02; F23C 6/04; F23D 11/36; F23D 11/406; F23D 11/404; F23D 14/22; F23D 14/20; F24C 2900/07021
See application file for complete search history.

(56) References Cited

U.S. PATENT DOCUMENTS

| | | | | |
|---|---|---|---|---|
| 2,573,502 A | | 10/1951 | Smith, Jr. | |
| 3,289,731 A | | 12/1966 | Gustav | |
| 3,349,826 A | * | 10/1967 | Poole | F23D 17/00 239/406 |
| 4,629,413 A | * | 12/1986 | Michelson | F23D 14/08 431/9 |
| 4,702,691 A | | 10/1987 | Ogden | |
| 5,195,884 A | * | 3/1993 | Schwartz | F23D 14/00 431/116 |
| 5,813,846 A | * | 9/1998 | Newby | F23D 14/24 431/9 |
| 6,379,146 B1 | | 4/2002 | Zink et al. | |
| 6,499,990 B1 | | 12/2002 | Zink et al. | |
| 6,565,361 B2 | * | 5/2003 | Jones | F23C 6/047 438/6 |
| 6,626,661 B1 | | 9/2003 | Zink et al. | |

(Continued)

FOREIGN PATENT DOCUMENTS

EP 1108952 A2 * 6/2001 ..... F23C 6/047

OTHER PUBLICATIONS

Platvoet, et al.; Process Burners 101; AIChE; Aug. 2013; pp. 35-39; US.

(Continued)

*Primary Examiner* — Alfred Basichas
(74) *Attorney, Agent, or Firm* — Dennis D. Brown; Brown Patent Law, PLLC

(57) ABSTRACT

A plugging resistant, highly stable free-jet burner and method which provide Ultra-Low $NO_x$ emissions using (a) large free-jet ejection ports, (b) a wide tip-to-tip spacing, and (c) auxiliary stabilization tips in the throat of the burner which are highly resistant to plugging and also produce very low levels of $NO_x$ emissions.

14 Claims, 11 Drawing Sheets

(56) References Cited

U.S. PATENT DOCUMENTS

| | | | | |
|---|---|---|---|---|
| 6,729,874 | B2 * | 5/2004 | Poe | F23D 14/10 431/278 |
| 6,875,008 | B1 * | 4/2005 | Martin | F23C 6/047 431/9 |
| 7,670,135 | B1 | 3/2010 | Zink et al. | |
| 7,878,798 | B2 * | 2/2011 | Poe | F23D 14/08 431/278 |
| 9,194,579 | B2 * | 11/2015 | Martin | F23D 14/84 |
| 9,222,668 | B2 | 12/2015 | Zink et al. | |
| 2003/0175638 | A1 * | 9/2003 | Stephens | F23M 11/042 431/9 |
| 2004/0018461 | A1 * | 1/2004 | Stephens | F23C 9/00 431/115 |
| 2013/0122440 | A1 * | 5/2013 | Zink | F23D 14/22 431/354 |
| 2017/0336068 | A1 | 11/2017 | Martin | |
| 2021/0080101 | A1 | 3/2021 | Zink et al. | |

OTHER PUBLICATIONS

CLSF Free-Jet Round Flame Combination Burner; Dec. 16, 2019; Zeeco; US.

PCT/US2021/031796—International Preliminary Report With International Search Report and Written Opinion; dated Sep. 20, 2021.

* cited by examiner

PLUGGING RESISTANT FREE-JET BURNER AND METHOD

FIELD OF THE INVENTION

The present invention relates to free-jet burners and methods, and methods of producing revamped free-jet burners, which are resistant to plugging and have high flame stability, while also producing low levels of $NO_x$ and other emissions.

BACKGROUND OF THE INVENTION

Industrial burners are commonly used in process heaters, boilers, furnaces, incinerators, and other fired-heating systems to produce heat for petroleum refining, chemical production, petrochemical operations, and other large-scale industrial processes.

The processing units in today's refineries, chemical plants, and other facilities must be capable of operating for increasingly longer periods of time without the need to shut down for major repairs and maintenance. In fact, the maintenance cycles in many refineries and other facilities are now up to four years, or longer. Consequently, the continued, reliable operation of burners and other critical equipment for very long periods of time is also becoming increasingly important.

One of the main causes of down time for industrial burners occurs when the fuel ports of the burner tips become plugged with debris or residue. The plugging of the fuel ports can lead to reduced or completely restricted fuel gas flow.

Another issue with industrial burners is that they are increasingly required to produce lower levels of $NO_x$ and other emissions. Other conditions being equal, $NO_x$ emissions increase as the temperature of the combustion process increases. As the temperature of the burner flame increases, the stability of the covalent bond of the $N_2$ in the burner air supply decreases, causing increased production of free nitrogen and thus also increasing the production of thermal $NO_x$ emissions. Consequently, in an ongoing effort to reduce $NO_x$ emissions, various types of burner designs and theories have been developed with the objective of reducing the peak flame temperature.

Thermal $NO_x$ reduction is generally achieved by slowing the rate of combustion. Since the combustion process is a reaction between oxygen and the burner fuel, the objective of delayed combustion is typically to reduce the rate at which the fuel and oxygen mix together and burn. The faster the oxygen and the fuel mix together, the faster the rate of combustion and the higher the peak flame temperature.

One type of low $NO_x$ burner which is very effective for slowing the rate of combustion and reducing peak flame temperatures is a free-jet burner. A free-jet burner will typically comprise: (i) a burner wall, (ii) an interior passageway for delivering a flow of air or other oxygen-containing gas out of the forward end of the burner wall, and (iii) a series of outer ejectors positioned to discharge fuel streams in free-jet flow outside of the burner wall to the burner flame. The flow momentum of the free-jet streams traveling outside of the burner wall entrains a significant amount of the gaseous products of combustion (flue gas) contained in the fired heating system, thereby recirculating the flue gas back into the combustion zone to form a diluted combustion mixture which burns at a lower peak flame temperature. This $NO_x$ reduction technique is referred to as Internal Flue Gas Recirculation (IFGR).

Unfortunately, as improved free-jet burners have been developed which provide lower and lower levels of $NO_x$ emissions, the plugging resistance of these burners generally has not improved. Rather, in some cases, the plugging resistance of the burners has deteriorated to some degree. One reason is that, in many cases, greater amounts of flue gas recirculation, further reductions in $NO_x$ emissions, and greater stability have been achieved by using a greater number of outer ejectors, having very small ejection ports (typically only $1/16^{th}$ inch in diameter), which are placed close together (i.e., less than 2 inches apart and more preferably only 1.5 to 1.8 inches apart). The small ejection ports are necessary for preventing interference between the adjacent fuel flow streams and facilitating flue gas entrainment.

However, the small ejection ports required by the prior free-jet burners are prone to plugging. The small fuel ejection ports can be plugged by tiny debris and/or limited buildup. Consequently, fuel strainers are generally not effective for preventing plugging, particularly in systems which have high levels of debris due to the age of the fuel pipes and/or other factors.

The use of auxiliary burner tips in free-jet burners and in other burners has also been problematic in regard to both plugging and $NO_x$ emissions. An auxiliary burner tip is a gas tip which is used to enhance the stability of the main flame of a burner, particularly during upset conditions. Examples of upset conditions which can cause the burner flame to become unstable include, but are not limited to: (a) a reduction in the air flow to the burner to a sub-stoichiometric level, (b) a loss of temperature in the fired-heating system to a level below the minimum temperature required for igniting the fuel, or (c) the occurrence of pressure excursions in the fired-heating system.

In the auxiliary burner tips currently used in the art, the speed of combustion and the peak flame temperature of the tip are typically sufficiently high that the use of one or more auxiliary tips can contribute significantly to the $NO_x$ emissions of the burner. Moreover, the auxiliary tips currently used in the art for purposes of flame stabilization are particularly susceptible to plugging. The fuel gas ports of these tips are very small, typically $1/16^{th}$ inch in diameter (i.e., a port flow area of only 0.0031 $in^2$). As a result, auxiliary tips are prone to plugging, even after filtration.

If plugging occurs in an auxiliary burner tip which is used to maintain the stability of the burner flame, the localized temperature at the stability point can be reduced until the stability of the flame can no longer be maintained and the flame is lost. When a loss of flame occurs in one or more burners of a multiple burner heating system, significant safety concerns can arise, including the risk of an explosion.

Consequently, a need exists for an improved free-jet burner which is resistant to plugging and provides a high degree of flame stability. The improved free-jet burner will preferably also produce very low levels of $NO_x$ and other emissions which are comparable to, or better than, the Ultra-Low emissions levels of the free-jet burners currently used in the art.

SUMMARY OF THE INVENTION

The present invention provides an improved free-jet burner and method of operation, and a method of revamping an existing free-jet burner, which satisfy the needs and alleviate the problems discussed above. The improved or revamped burner is highly resistant to plugging and provides a high degree of flame stability. The inventive burner and method also provide Ultra-Low $NO_x$ emission levels which are comparable to, or better than, the emissions levels produced by the free-jet burners currently used in the art, which require the use of small fuel discharge ports and are prone to plugging.

In one aspect, there is provided an improved burner for providing low $NO_x$ emissions, wherein the burner is for use in a heating system having a flue gas therein and the burner is of a type comprising (i) a burner wall having a forward end, (ii) an interior passageway of the burner wall for a flow of air or other oxygen-containing gas out of the forward end of the burner wall, and (iii) a series of ejectors positioned to deliver a fuel from the ejectors in free-jet flow streams outside of the burner wall either directly or indirectly to a main burner flame at and/or forwardly of the forward end of the burner wall. For this burner, the improvement preferably comprises: (a) using large fuel ejection ports in the ejectors having a flow area of at least 0.0068 $inch^2$ which provide resistance to plugging; (b) using a wide tip-to-tip spacing between the ejectors of from 2 to 14 inches which provides enhanced recirculation of the flue gas to the main burner flame for the free-jet flow streams from the large fuel ejection ports; and (c) positioning one or more auxiliary burner tips in the internal passageway of the burner wall to stabilize the main burner flame, each said auxiliary burner tip having a large fuel discharge port with a flow area of at least 0.012 $inch^2$ which provides resistance to plugging.

In another aspect, there is provided an improved method of operating a burner for low $NO_x$ emissions wherein (a) the burner comprises a burner wall having a forward end and an interior passageway through which a stream of air or other oxygen-containing gas flows out of the forward end of the burner wall, (b) the burner is operated in a heating system, and (c) the method is of a type comprising the step of ejecting a fuel from a series of ejectors in free-jet flow streams outside of the burner wall either directly or indirectly to a main burner flame at and/or forwardly of the forward end of the burner wall. For this method, the improvement preferably comprises: (i) increasing the resistance to plugging of the ejectors by using large fuel ejection ports in the ejectors having a flow area of at least 0.0068 $inch^2$; (ii) enhancing the recirculation of a flue gas in the heating system to the main burner flame for the free-jet flow streams from the large fuel ejection ports of the ejectors by using a wide tip-to-tip spacing between the ejectors of from 2 to 14 inches; and (iii) enhancing the stability of the main burner flame using one or more auxiliary burner tips positioned in the internal passageway of the burner wall, each said auxiliary burner tip having a large fuel discharge port with a flow area of at least 0.012 $inch^2$ which provides resistance to plugging.

In another aspect, there is provided a method of increasing the plugging resistance and maintaining low $NO_x$ emissions of an existing burner having (i) a burner wall, (ii) an interior passageway of the burner wall through which a flow of air or other oxygen-containing gas is discharged from a forward end of the burner wall, and (iii) a series of a number x of original ejectors which are positioned outside of and spaced around the interior passageway of the burner wall and which deliver a fuel from the ejectors in free-jet flow streams outside of the burner wall either directly or indirectly to a main burner flame at and/or forwardly of the forward end of the burner wall. The method preferably comprises the steps of: (a) increasing a tip-to-tip spacing by removing every other one of the original ejectors so that the number of remaining ejectors will be (i) one half of the number x of the original ejectors if the number x of the original ejectors is an even number or (ii) not more than $((x-1)/2)+1$ if the number x of the original ejectors is an odd number; (b) replacing each of the remaining ejectors with a plugging resistant ejector having a large fuel ejection port with a flow area of at least 0.0068 $inch^2$; and (c) stabilizing the main burner flame by installing at least two auxiliary burner tips in the internal passageway of the burner wall, each of the auxiliary burner tips having a large fuel discharge port with a flow area of at least 0.012 $inch^2$ which provides resistance to plugging, and each of the auxiliary burner tips directing an auxiliary tip flame onto a surrounding shoulder at the forward end of the burner wall or onto a ledge or other interior feature of the burner wall.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
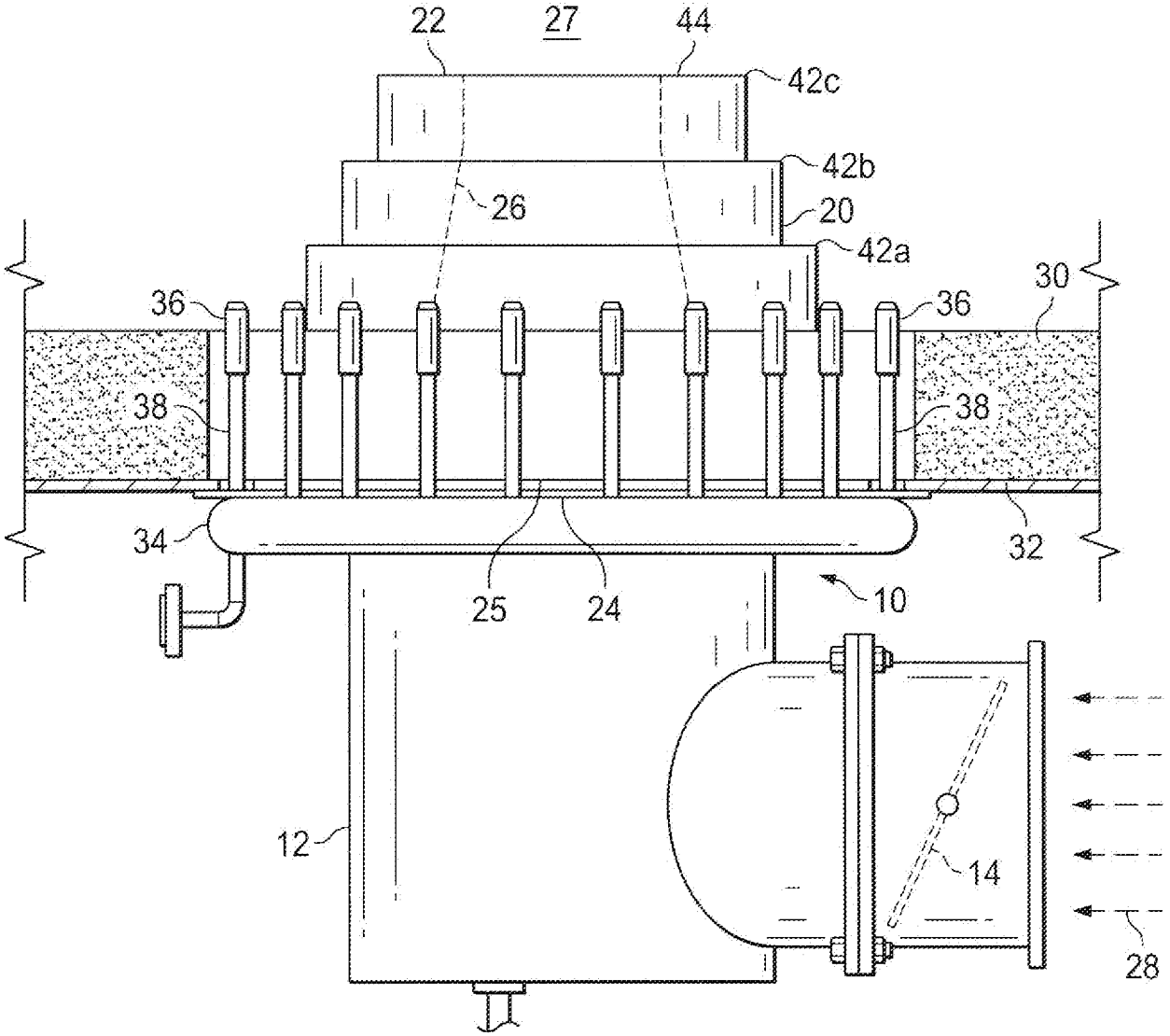
FIG. 1 is an elevational side view of an embodiment 10 of an improved free-jet burner provided by the present invention.

Before explaining the present invention in detail, it is important to understand that the invention is not limited in its application to the details of the preferred embodiments and steps described herein. The invention is capable of other embodiments and of being practiced or carried out in a variety of ways. It is to be understood that the phraseology and terminology employed herein are for the purpose of description and not of limitation.

As will be understood by those skilled in the art, the term "free jet," as used herein and in the claims, refers to a flow issuing from a port of an ejector tip, a nozzle, or other ejector into a fluid which, compared to the flow, is more at rest. In the present invention, the fluid issuing from the ejector can be a gas fuel and/or a liquid fuel, but is preferably a gas fuel, and the fluid substantially at rest is the flue gas present within the heating system. For purposes of the present invention, the heating system can be a process heater, a boiler or generally any other type of heating system used in the art. The flue gas present within the system will comprise the gaseous products of the combustion process.

As noted, the fuel used in the inventive burner and method will preferably be a gas fuel but can alternatively be a liquid fuel, or can be a fuel having both gas and liquid phases. The gas fuel used in the inventive burner and method can be natural gas, a refinery fuel gas, hydrogen, or generally any other type of gas fuel or gas fuel blend employed in process heaters, boilers, or other gas-fired heating systems. The free-jet flow employed in the inventive system operates to entrain flue gas and to thoroughly mix the flue gas with each fuel stream as it travels to the main burner flame at or forwardly of the outlet end of the burner wall.

Referring now to the drawings, FIGS. 1-4 depict an embodiment 10 of the inventive burner apparatus. Burner 10 comprises a housing 12 and a burner wall 20 having an outlet or forward end 22, a base end 25, and internal passageway or throat 26 which extends through and is surrounded by the burner wall 20. The outlet end 22 of the burner wall 20 is in communication with the interior 27 of the furnace or other heating system enclosure in which combustion takes place and which therefore contains combustion product gases (i.e., flue gas). Burner 10 is shown as installed through the floor or other wall 32 of the heating system, which is typically formed of metal. Insulating material 30 will typically be secured to the interior of the furnace floor or wall 32.

The burner wall 20 is preferably constructed of a high temperature refractory burner tile material. However, it will be understood that the burner wall 20 can alternatively be formed of, or provided by, the furnace floor or other wall, a metal band, a refractory band, or any other material or structure which is capable of (a) providing an acceptable flow passageway for air or other oxygen-containing gas into the heating system enclosure 27 and (b) withstanding the high temperature conditions therein.

Combustion air or other oxygen-containing gas 28 is received in housing 12 and directed by the housing 12 into the inlet end 24 of burner throat 26. The air or other oxygen-containing gas 28 exits the burner 10 at the outlet end 22 thereof. The quantity of combustion air or other oxygen-containing gas entering the housing 12 is regulated by inlet damper 14. The air or other oxygen-containing gas 28 can be provided to housing 12 as necessary by forced circulation, natural draft, a combination thereof, or in any other manner employed in the art.

A series of outer tips, nozzles, or other fuel ejectors 36 surrounds burner wall 20. In embodiment 10 of the inventive burner, each ejector 36 is depicted as comprising a fuel ejection tip 36 secured on the end of a fuel pipe 38. Each fuel pipe 38 is in communication with a fuel supply manifold 34 and can either extend through a lower skirt portion of the burner tile 20 or be affixed within the insulating material 30 attached to furnace wall 32. While the fuel pipes 38 are illustrated as being risers connected to a fuel supply manifold 34, it will be understood that any other type of fuel supply system can alternatively be used in the present invention.

Figure 2:
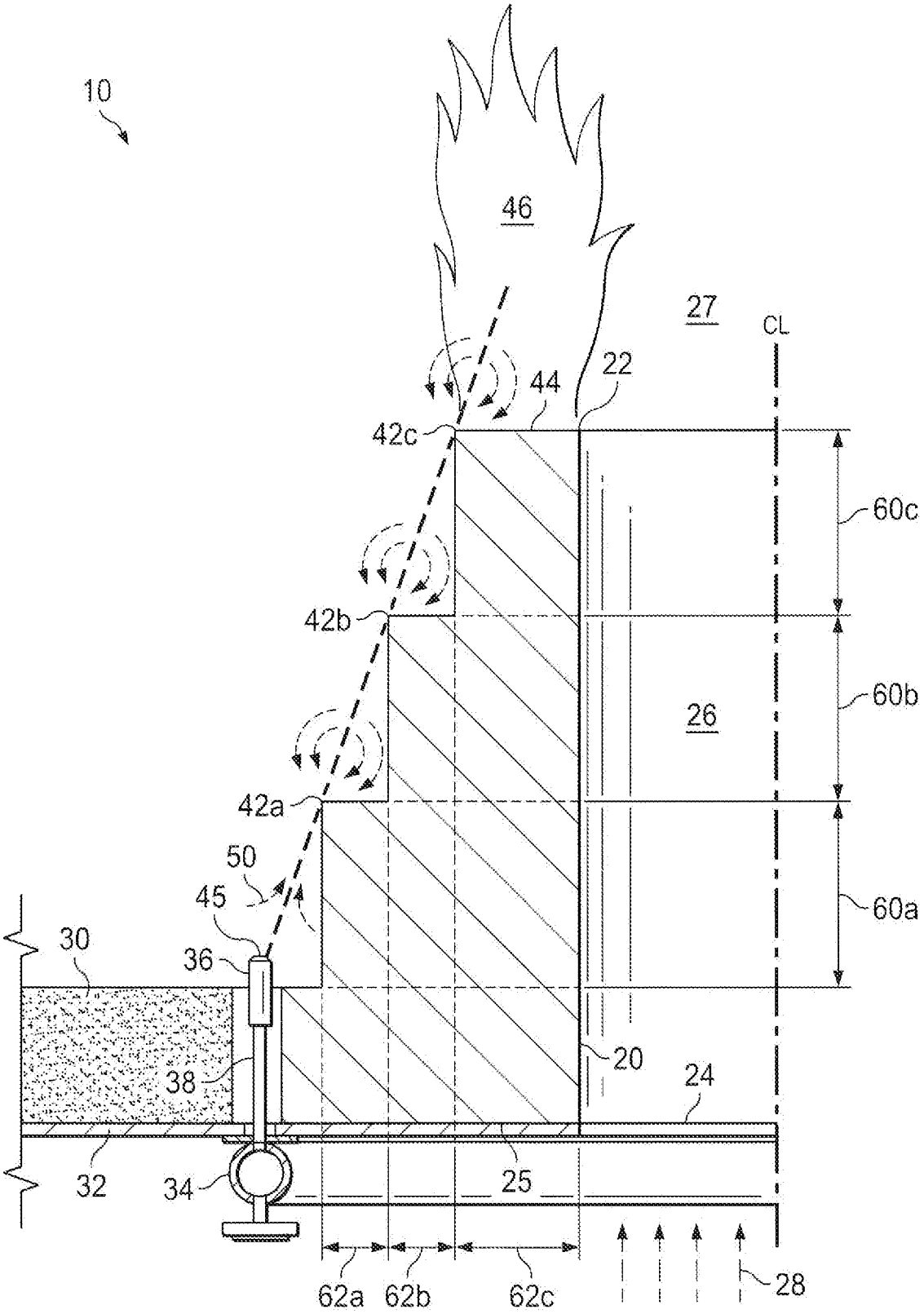
FIG. 2 is a partial cutaway side view of the inventive burner 10.
Figure 3:
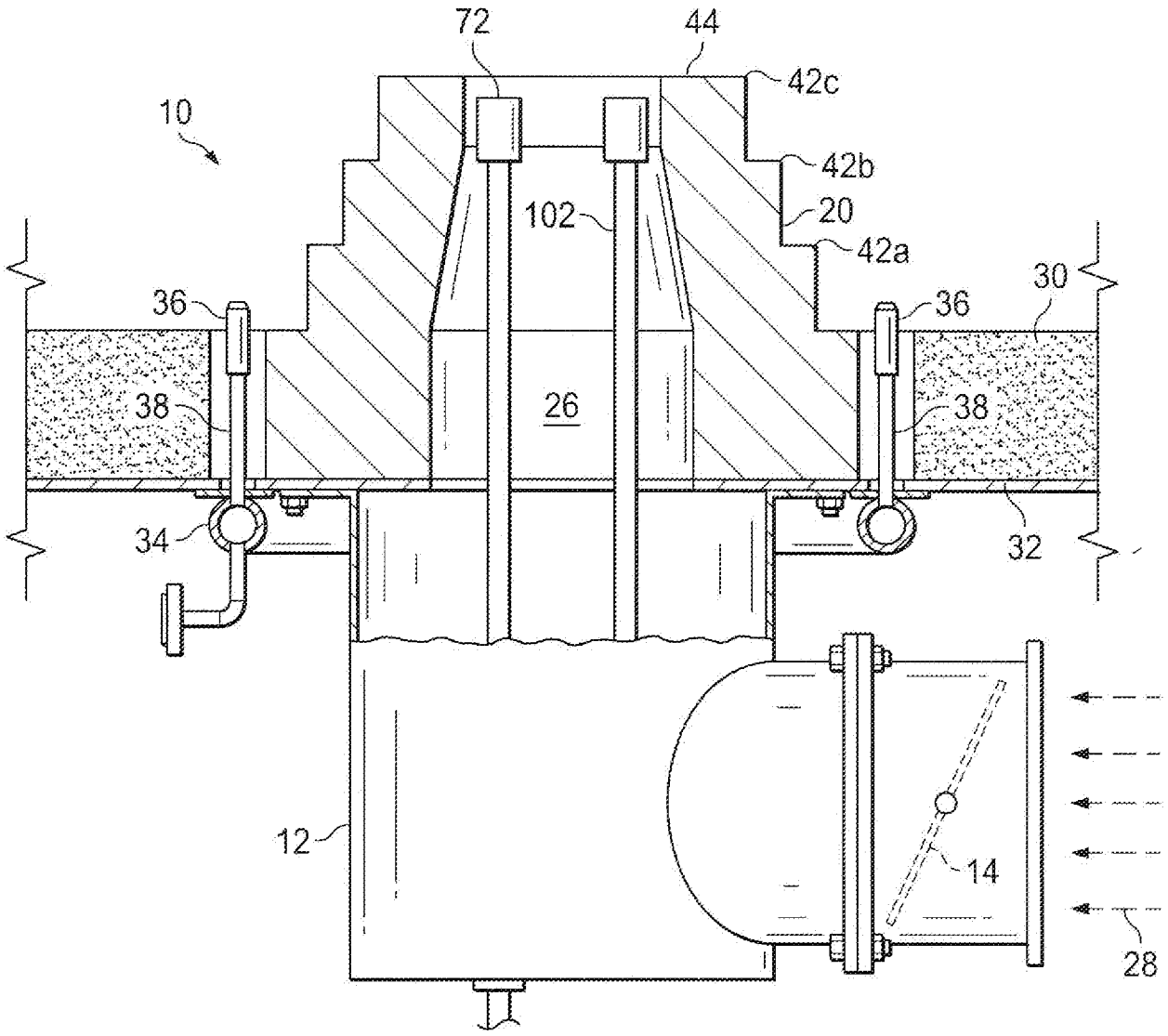
FIG. 3 is a cutaway side view of the inventive burner 10.
Figure 4:
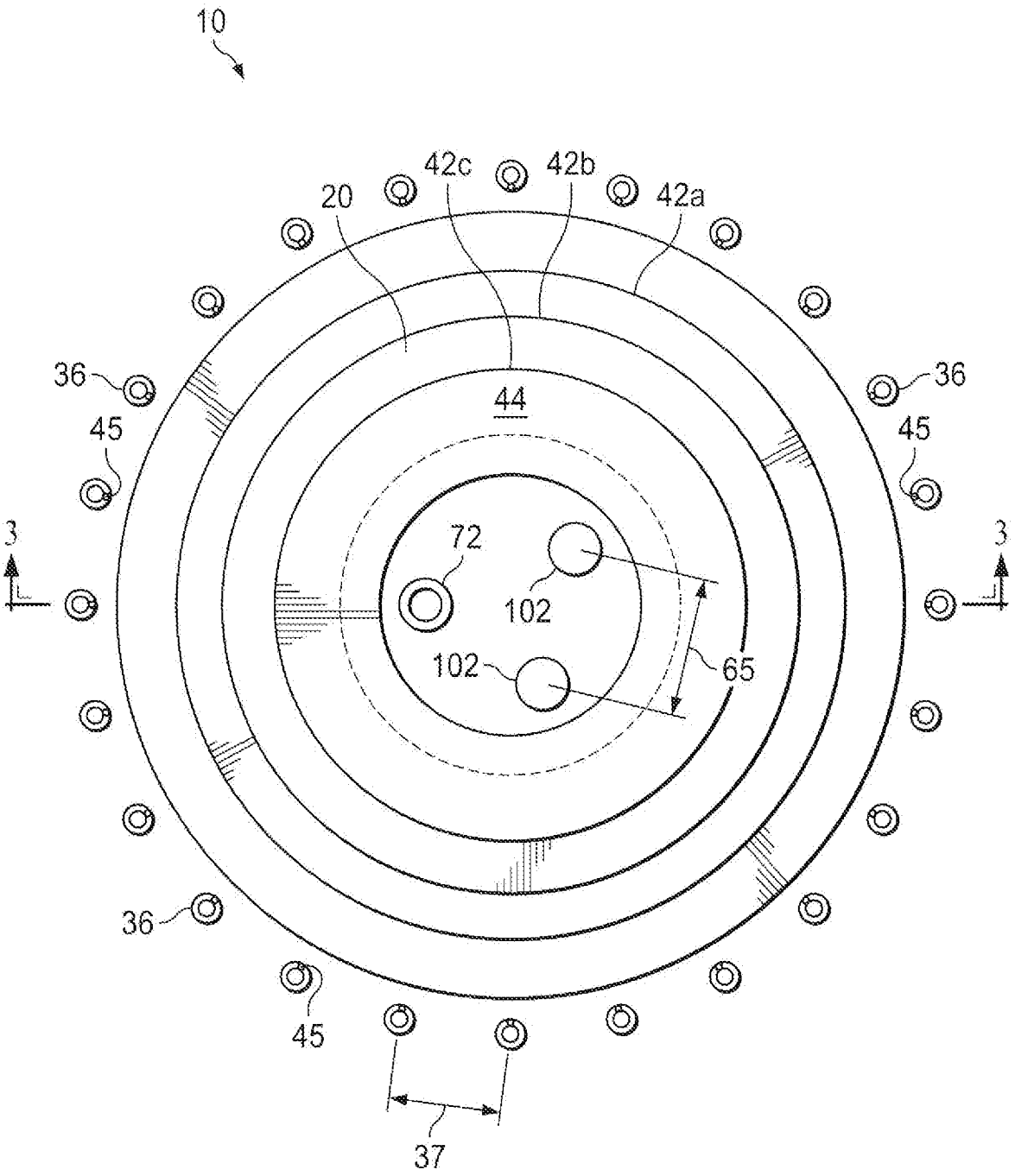
FIG. 4 is a plan view of the inventive burner 10.
Figure 5:
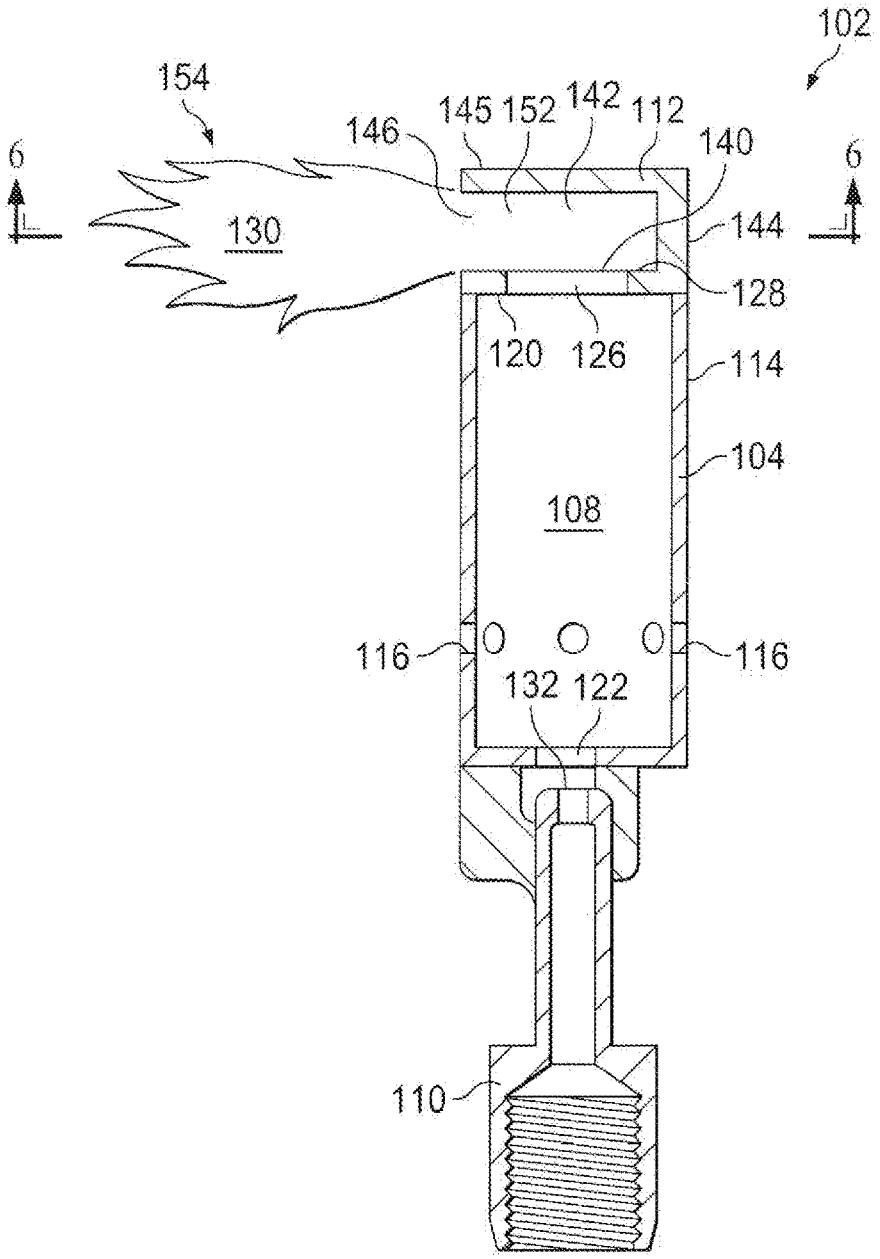
FIG. 5 is a cutaway elevational view of an auxiliary burner tip 102 used in the inventive burner 10.
Figure 6:
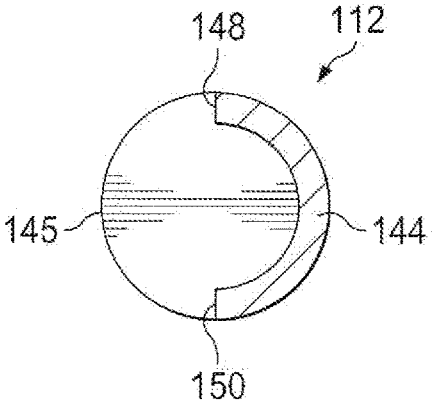
FIG. 6 is a cutaway view of a flame diverter 112 of the auxiliary tip 102 as seen from the perspective 6-6 shown in FIG. 5.
Figure 7:
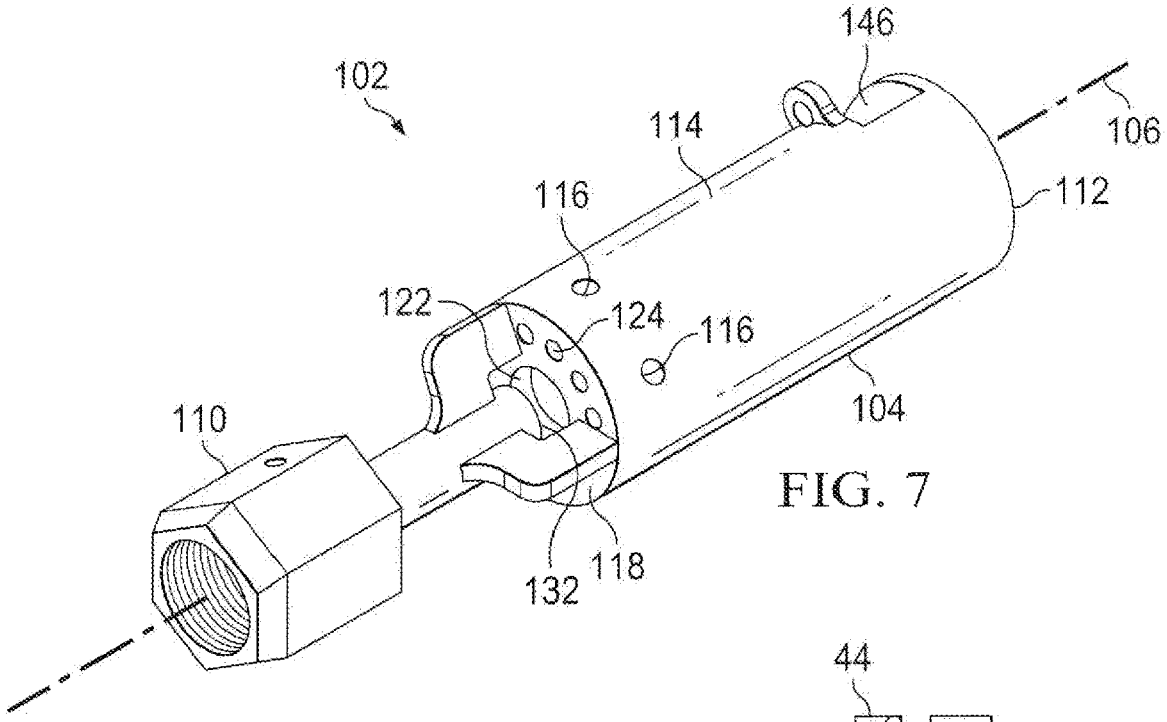
FIG. 7 is a perspective view of the auxiliary burner tip 102.
Figure 8:
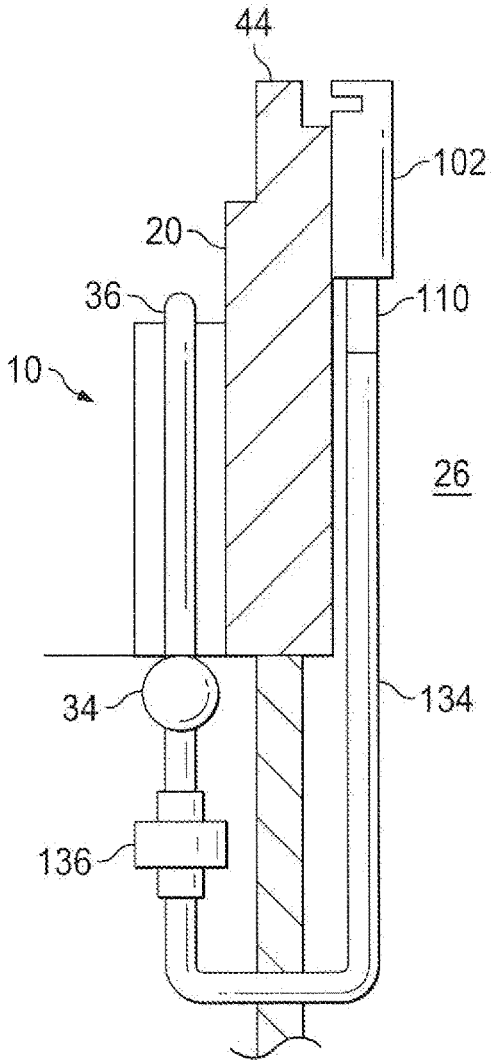
FIG. 8 schematically illustrates the auxiliary burner tip 102 installed in the inventive burner 10.

Each ejector 36 has an ejection port 45 drilled or otherwise provided therein which is preferably oriented to deliver a free-jet fuel stream 50 either directly (as illustrated in FIG. 2) or indirectly to a main burner flame 46 at or forwardly of the forward end 22 of the burner wall 20. Delivering a free-jet fuel stream 50 "indirectly" to the main burner flame 46 means, e.g., that the ejection port 45 of one or more of the ejectors 36 can alternatively be oriented to direct one or more fuel streams 50 at more of an inward angle toward the burner wall 20 or at more of an outward angle away from the burner wall such that the momentum of the air or other oxygen-containing gas 28 as it flows out of the forward end 22 of the burner wall 20 draws the indirect fuel steam(s) 50 back into the main burner flame 46. As each free-jet fuel stream 50 flows to the main burner flame 46, flue gas from the furnace enclosure is entrained therein and mixes therewith.

The ejectors 36 are located outside of and at least partially around (preferably entirely around) the internal passageway 26 of the burner wall 20 so that the free-jet fuel streams 50 travel outside of the burner wall 20. As depicted in the drawings, the ejectors 36 are preferably located in proximity to the base 25 of burner wall 20 such that they are positioned longitudinally rearward of and laterally outward from the outer or forward end 22 of the burner wall 20.

A burner pilot 72 can optionally be located within the interior passageway 26 to initiate combustion at the outer end 22 of the burner 10.

In accordance with the improvements provided by the burner and method of the present invention, the plugging resistance of the ejectors 36 of the inventive burner 10 is increased by using large ejection ports 45 in the ejectors 36. The large fuel ports 45 will preferably be drilled ports having a circular shape, but can alternatively be square, oval, or any other shape desired. In each case, the large fuel port 45 of each ejector 36 will preferably have a flow area of at least 0.0068 $inch^2$ (i.e., a diameter of at least 3/32 inch for a circular port) and will more preferably have a flow area of at least 0.012 $inch^2$ (i.e., a diameter of at least $1/8^{th}$ inch for a circular port). The flow area of each of the large fuel ports 45 will more preferably be in the range of from 0.012 to 0.096 $inch^2$ and will most preferably be about 0.012 $inch^2$ (i.e., a diameter of 1/8 inch for a circular port).

Also in accordance with the improvements provided by the burner and method of the present invention, a wide spacing 37 between the ejectors 36 (referred to herein as a wide tip-to-tip spacing) is also used. The wide tip-to-tip spacing 37 between the ejectors 36 will preferably be from 2 to 14 inches and will more preferably be from 3.5 to 10 inches. The tip-to-tip spacing 37 between the ejectors 36 will most preferably be about 3.5 to 6 inches.

These improvements, i.e., using large fuel ejection ports 45 and a wide tip-to-tip spacing 37 are counter to the conventional wisdom and the current practices in the industry for reducing $NO_x$ emissions and providing burner stability. As noted above, it is believed in the industry that $NO_x$ reductions and burner stability are best achieved by using a greater number of ejectors which have very small ejection ports of only $1/16^{th}$ inch in diameter and are positioned very close together at a tip-to-tip spacing of less than 2 inches, and more preferably not more than 4 inches.

In the inventive burner 10, all else being equal, although the use of the large fuel ports 45 in the ejectors 36 provides resistance to plugging, it also reduces the amount of flue gas which is drawn into the combustion mixture by the free-jet streams 50 and by the momentum of the stream of air or other oxygen-containing gas exiting the forward end 22 of the burner wall 20. This in turn reduces the degree of dilution of the combustion mixture which undesirably accelerates the combustion process, increases the peak flame temperature, and increases the level of $NO_x$ and other emissions produced by the burner.

In the inventive burner 10, the amount of flue gas which is recirculated to the combustion mixture for the main burner flame 46 is enhanced and restored by using the wide tip-to-tip spacing 37 between the ejectors 36. The increased tip-to-tip spacing 37 creates wider flow channels between the ejectors 36 for the recirculation of the flue gas, which in turn enables the free-jet streams 50 and the momentum of the air or other oxygen-containing gas to pull an amount of flue gas into the combustion mixture which is substantially the same as or exceeds the amount of IFGR which is achieved in the prior free-jet burners. Because of the amount of IFGR achieved in the inventive burner 10, the amount of $NO_x$ emissions produced by the inventive burner 10 will be an Ultra-Low level of less than 10 ppmv in a process furnace with a furnace temperature of 1,400 F, ambient air temperature, 10% excess air, natural gas fuel with 30 psig fuel gas pressure and will more preferably be in the range of from 5 ppmv to 18 ppmv for most process furnace applications.

However, although the ejectors 36 used in the inventive burner 10 provide resistance to plugging and the wide tip-to-tip spacing 37 of the ejectors 36 increases the amount of IFGR achieved in the combustion mixture, a reliable, improved means of maintaining the stability of the main burner flame 46, particularly during upset conditions, was still needed. As mentioned above, a loss of stability can increase the chances of a burner flame-out if, for example, the burner experiences a significant reduction in air flow, or there is a significant loss of temperature in the heating system, or a pressure excursion occurs in the heating system. The potential for a loss of flame in one or more burners of a multiple burner heating system creates significant safety concerns, including the risk of an explosion.

Unfortunately, as also mentioned above, the auxiliary burners heretofore used by in the art for improved stability were themselves prone to plugging, which also presented a serious flame-out risk. In addition, the level of $NO_x$ emissions produce by the prior auxiliary burner tips was not satisfactory.

In accordance with the improved burner and method of the present invention, the need for ensuring the continued stability of the main burner flame 46 is met by using one or more auxiliary burner tips 102 positioned in the internal passageway 26, of the burner wall 20, which are resistant to plugging and therefore do not themselves present a flame-out risk. Moreover, unlike prior auxiliary burner tips used in the art for various purposes, each auxiliary burner tip 102 used in the inventive burner and method preferably produces a very low level of $NO_x$ emissions which does not contribute significantly to the total emissions of the inventive burner 10.

To prevent plugging, each auxiliary burner tip 102 used in the inventive burner 10 has a large fuel discharge port 132 which preferably has a flow area of at least 0.012 $inch^2$ (i.e., a diameter of at least ⅛ inch for a circular port) and more preferably has a flow area of at least 0.049 $inch^2$ (i.e., a diameter of at least ¼$^{th}$ inch for a circular port). The flow area of the large fuel discharge port 132 will more preferably be in the range of from 0.049 to 0.06 $inch^2$ and will most preferably be about 0.049 $inch^2$. Also, in order to provide low levels of $NO_x$ emissions, each auxiliary burner tip 102 is preferably either a sub-stoichiometric, staged air burner tip or a lean pre-mix burner tip.

The number of auxiliary tips 102 used in the inventive burner 10 can be any number y suitable for maintaining the stability of the burner flame 46, particularly when subjected to upset conditions of the type described above. By way of example, but not by way of limitation, for a burner 10 having a heat output of less than 15 MMBtu/hour, and assuming that the burner 10 includes a burner pilot 72 located within the interior passageway 26 for initiating combustion at the outer end 22 of the burner 10, two auxiliary burner tips 102 will preferably be included in the interior passageway 26. For any number y>1 of auxiliary tips 102 used in the burner 10, given that the size and dimensions of the inventive burner 10 can range from small to very large depending upon the service in which the burner 10 is used and the amount of heat output required, the spacing 65 between each adjacent pair of the auxiliary burner tips 102 will typically be in the range of from 5 to 24 inches or more and will more preferably be in the range of from 10 to 18 inches.

Each auxiliary burner tip 120 used in the inventive burner and method is preferably a staged air, sub-stoichiometric burner tip as illustrated in FIGS. 5-8. The auxiliary burner tip 102 preferably comprises: a tip shield housing 104 having a longitudinal axis 106; a mixing chamber 108 contained within the shield housing 104; a gas fuel spud 110 positioned to discharge a gas fuel into the rearward longitudinal end of the mixing chamber 108; and a flame diverter 112 on the forward longitudinal end of the shield housing 104.

The tip shield housing 104 preferably comprises a longitudinally extending outer wall 114 which surrounds the mixing chamber 108. The outer wall 114 is preferably cylindrical but can alternatively have a square, oval, or other cross-sectional shape. A series of small openings 116 is preferably provided around and through a rearward portion of the outer wall 114 to serve as contingency relief openings for gas expansion in the event that combustion occurs within the shield housing 104 itself.

The lateral base wall 118 at the rearward end of the mixing chamber 108 has at least a central opening 122 provided therethrough. As the gas fuel is discharged into the rearward end of the mixing chamber 108 by the gas fuel spud 110, the momentum of the gas fuel stream draws air or other oxygen-containing gas, from the interior passageway 26 of the burner 10, into the mixing chamber 108 through the central base opening 122. In addition, the momentum of the gas fuel preferably also draws air or other oxygen-containing gas into the mixing chamber 108 through a plurality of openings 124 which are formed through the base wall 118 of the shield housing 104 around the central base opening 122. The surrounding openings 124 are preferably smaller that the central base opening 122. The base openings 122 and 124 are preferably sized such that the total amount of air or other oxygen-containing gas which is drawn into the mixing chamber 108 is a sub-stoichiometric amount, i.e., an amount which is not sufficient for burning all of the gas fuel which is discharged into the mixing chamber 108 by the gas fuel spud 110.

The flame stabilization ring 120 at the forward end of the mixing chamber 108 has a central discharge opening 126 provided therethrough which is smaller than the cross-sectional diameter or area of the mixing chamber 108 so that the flow of the sub-stoichiometric mixture of fuel and oxygen-containing gas from the mixing chamber 108 through the flame stabilization ring 120 creates a reduced pressure area 128 on or near the stabilization ring 120 which assists in holding and otherwise stabilizing the flame 130 of the auxiliary tip 102.

The gas fuel spud 110 includes the large fuel discharge port 132 at the forward end thereof for discharging the gas fuel into the rearward longitudinal end of the mixing chamber 108. The fuel discharge port 132 of the spud 10 is preferably positioned rearwardly of the base wall 118 of the shield housing 104 so that the spud 110 discharges the gas fuel forwardly through the central opening 122 of the base wall 118. The fuel discharge port 132 can be formed directly in the forward end of the gas fuel spud 110 or can be formed in an orifice plug which is placed in the forward end of the spud 110.

In addition to the use of the large discharge port 132, the gas fuel spud 110 is preferably connected to a gas fuel supply line or riser 134 having an orifice union 136 therein which contains a flow orifice. The flow area of the flow orifice (a) is preferably at least 0.0068 $inch^2$ (which is equivalent to a circular orifice diameter of at least 3/32 inch) and will more preferably be at least 0.012 $inch^2$ (which is equivalent to a circular orifice diameter of at least 1/8 inch) but (b) is also preferably less than the size of the fuel spud discharge port 132. The flow area of the flow orifice will more preferably be in the range of from 0.012 $inch^2$ to about 0.014 $inch^2$ and will most preferably be about 0.012 $inch^2$. In the event that the system contains any debris of sufficient size to plug even the large discharge port 132 of the gas fuel spud 110, the debris will be stopped by the flow orifice in the orifice union 36, which will be positioned outside of the fired-heating system and can be easily cleaned. The flow orifice can also be used to meter the rate of flow of the gas fuel to the auxiliary burner tip 102 from the external fuel supply manifold 34.

The flame diverter 112 on the forward longitudinal end of the shield housing 104 preferably comprises: a rearward opening 140; an interior flame space 142; a longitudinally extending side wall 144 which extends partially around the interior flame space 142; an end wall 145 at the forward longitudinal end of the side wall 144; and a lateral side opening 146. The end wall 145 is preferably a solid circular end wall which extends laterally over and covers the interior flame space 142. The longitudinally extending side wall 144 of the flame diverter 12 has a semicircular lateral cross-sectional shape which extends from a first arc end point 148 to a second arc end point 150. The semicircular cross-sectional shape of the longitudinally extending side wall 144 is preferably an are in the range of from 120° to 270° which extends from the first arc end point 148 to the second arc end point 150 and is more preferably an are of about 180°.

The lateral side opening 146 of the flame diverter 112 preferably (a) extends from the first arc end point 148 to the second arc end point 150 of the side wall 144 in the lateral cross-sectional plane and (b) extends longitudinally from the lateral flame stabilization ring 120 to the end wall 145 of the flame diverter 112. The lateral side opening 146 is preferably oriented to discharge the flame 130 of the auxiliary burner tip 102 laterally outward at an angle which is in the range of from 60° to 120°, more preferable about 90°, with respect to the longitudinal axis 106 of the tip shield housing 104.

In order to maintain the stability of the main burner flame 46, the flame diverter 112 preferably diverts and directs the auxiliary tip flame 130 laterally outward onto (a) the forward end 44 of the burner wall 20, (b) an internal ledge, shoulder or other internal feature of the burner wall 20, or (c) any other stability point of the burner 10. Moreover, the diversion of the auxiliary tip flame 130 by the flame diverter 112 advantageously provides a staged air operating regime for the sub-stoichiometric auxiliary tip 102 which reduces the $NO_x$ emissions produced by the auxiliary tip 102.

In the staged air operation of the auxiliary burner tip 102, the sub-stoichiometric, fuel rich, mixture of gas fuel and oxygen-containing gas (preferably air) flowing out of the forward end of the mixing chamber 108 begins combustion in a sub-stoichiometric combustion region 152, which includes the interior flame space 142 of the flame diverter 112. Next, the auxiliary tip flame 130 is diverted laterally into the air or other oxygen-containing gas flowing through the interior passageway 26 of the inventive burner 10, outside of the auxiliary burner tip 102. The diversion of the auxiliary tip flame 130 into the flow of air, or other oxygen-containing gas, creates a fuel lean combustion region 154, outside of the auxiliary tip 102, in which the remaining portion of the gas fuel which was not combusted in the sub-stoichiometric combustion zone 152 of the auxiliary tip 102 is burned.

The staged air operation provided by combusting a first portion of the auxiliary tip fuel in the sub-stoichiometric flame region 152 followed by combustion of the remainder of the fuel in the fuel lean flame region 154 reduces the peak temperature of the auxiliary tip flame 130 in in both regions and thereby reduces the levels of $NO_x$ and other emissions produced by the auxiliary tip 102.

Although the inventive burner 10 is illustrated in the drawings as being in a vertical orientation, it will be understood that the burner 10 can alternatively be oriented downwardly, horizontally, or at any other desired angle. In addition, although various elements and features of the inventive burner 10 are shown and may be described as having cylindrical or circular shapes, it will be understood that these elements and features can alternatively be square or oval in shape, or can be of any other shape desired.

As exemplified in other embodiments shown and described herein, the burner wall 20 of inventive burner 10 can be circular, square, rectangular, or generally any other desired shape. In addition, the series of fuel ejectors 36 employed in the inventive burner 10 need not entirely surround the burner wall 20. For example, the series ejectors 36 may only partially surround the burner wall 20 in certain applications where the inventive burner 10 is used in a furnace sidewall location or is specially configured to provide a desired flame shape.

Also, although only a single series of ejectors 36 surrounding the burner wall 20 is shown in FIGS. 1-4, it will be understood that the burner 10 could have one or more additional series of ejectors spaced radially outward and/or radially inward from the series of ejectors 36. The main burner flame 46 can also comprise either a single combustion stage or multiple combustion stages. Additional fuel tips or pre-mix tips for the main burner flame 46 can also be included in the interior passage 26 of the burner wall 10. Further, other possible additions to the burner 10 can include a regen tile, a swirler, and/or a stabilization cone in the burner throat 26, particularly in the event that a liquid fuel is ejected within or just outside of the forward end of the burner throat 26.

To further facilitate the entrainment and mixing of flue gas with the fuel jet flow streams 50, the inventive burner 10 preferably comprises one or more exterior impact structures 42*a-c* which can be positioned at least partially within the paths of some or all of the flow streams 50. Each such impact structure 42*a-c* can generally be any type of obstruction which will decrease the flow momentum and/or increase the turbulence of the fuel streams 50 sufficiently to promote flue gas entrainment and mixing while allowing the resulting mixture to flow on to the main burner flame 46.

Although other types of impact structures 42*a-c* can be employed, the impact structures 42*a-c* used in the inventive burner 10 will most preferably be tiered ledges or other features of a type which can be conveniently formed in a poured refractory as part of and/or along with the burner wall 20. In addition, although three impact ledges 42*a-c* are shown in FIGS. 1-4, it will be understood that the inventive burner 10 can have any number from one to n of such tiered ledges 42 and that the number n of tiered ledges used in the inventive burner 10 will preferably be in the range of from 2 to 6.

The burner wall 20 employed in inventive burner 10 provides a particularly desirable tiered exterior shape wherein the diameter of the base 25 of the burner wall 20 is broader than the forward end 22 thereof and the exterior of the burner wall 20 presents a series of concentric, spaced apart, impact ledges 42 *a-c*. The outermost impact ledge 42*c* is defined by the flat, radial, surrounding shoulder 44 at the forward end 22 of burner wall 20. At least one, preferably at least two, additional impact ledges 42*a* and 42*b* are then positioned on the exterior of burner wall 20 between the ejectors 36 and the forward shoulder/ledge 42*c*. Proceeding from the outer end 22 to the base 25 of the burner wall 20, each additional ledge 42 is preferably broader in diameter than, and is spaced longitudinally rearward of and laterally outward from, the previous ledge 42.

Depending upon the characteristics and size of the heating system in which the inventive burner 10 is used, and the amount of heat output required, the size and dimensions of the burner 10 can range from small to very large. Consequently, the longitudinal height 60*a-c* of each of the tiered ledges 42*a-c* of the burner 10 can be in the range of from 0.05 to 10 inches or more. However, for most applications the longitudinal height 60*a-c* of each ledge 42*a-c* will preferably be in the range of from 2 to 5 inches. Similarly, the radial width 62*a-e* of each impact ledge 42*a-c* can be in the range of from 0.05 to 10 inches or more. However, for most applications the radial width 62*a-c* of each impact ledge 42*a-c* will preferably be in the range of from 0.5 to 3 inches and will more preferably be in the range of from 1 to 2 inches.

As illustrated, for example, in FIG. 1, the internal passageway 26 extending through the burner wall 20 can be a tapered throat having a wider diameter at the base 25 than at the outer end 22 of the burner wall 20. A tapered throat 26 of the type depicted in FIG. 1 provides a choke point for the flow of air or other oxygen-containing gas which increases the velocity of the flow and creates even more of a reduced pressure region at the outer end 22 of the burner 10. The enhanced reduced pressure region assists in (a) holding the main burner flame 46 on or closely adjacent to the surrounding radial shoulder 44 at the forward end 22 of the burner wall 20 and (b) drawing additional flue gas into the main flame combustion mixture.

Because the entire quantity of fuel used in the inventive burner 10 is so well conditioned with the furnace flue gas, combustion occurs at a significantly reduced rate and lower flame temperature, thus resulting in lower $NO_x$, emissions.

Figure 9:
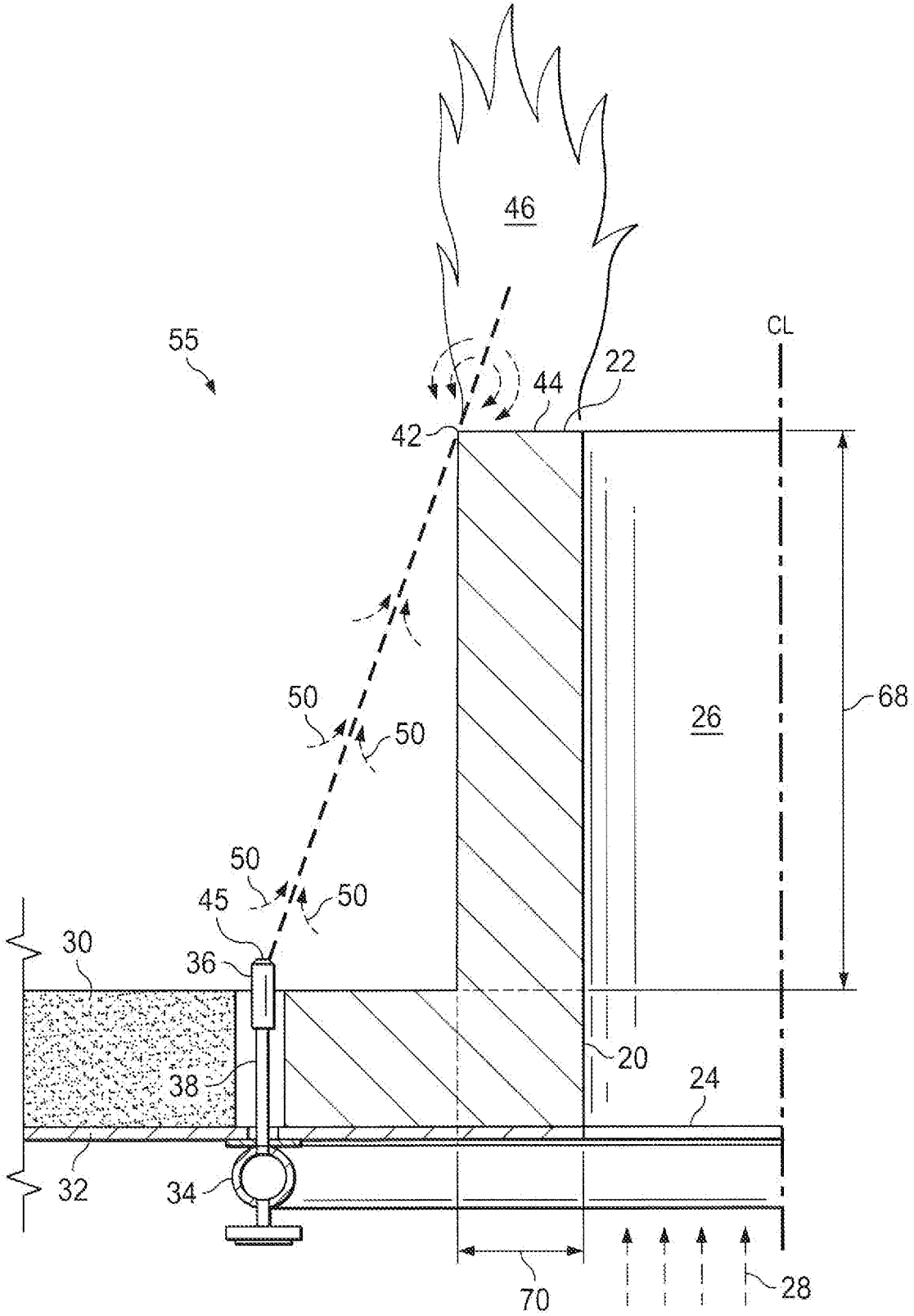
FIG. 9 is a cutaway partial elevational side view of an alternative embodiment 55 of the improved free-jet burner provided by the present invention.

An alternative embodiment 55 of the inventive burner is depicted in FIG. 9. Burner 55 is substantially identical to burner 10 except that the exterior of the burner wall 20 is substantially cylindrical in shape such that the burner wall 20 has only a single impact ledge 42 provided at the outer end 44 thereof. The longitudinal height 68 of the single impact ledge 42 can be in the range of from 0.05 to 20 inches or more and will more typically be in the range of from 2 to 5 inches. The radial width 70 of the surrounding shoulder 42 at the forward end of the burner wall 20 of the burner 55 can be in the range of from 0.05 to 15 inches or more and will more typically be in the range of from 0.2 to 2.25 inches.

Figure 10:
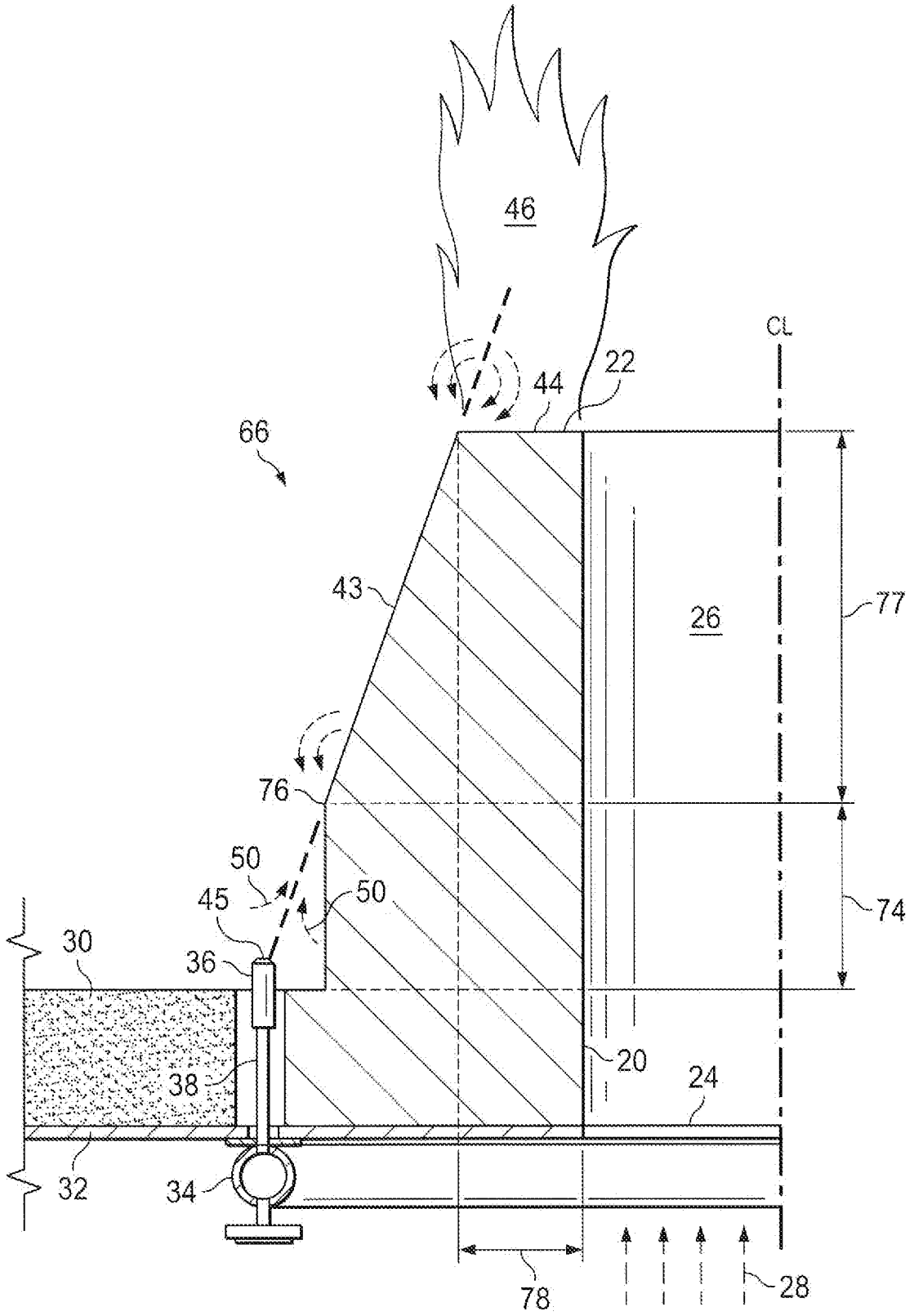
FIG. 10 is a cutaway partial elevational side view of an alternative embodiment 66 of the improved free-jet burner provided by the present invention.

FIG. 10 shows another alternative embodiment 66 of the inventive burner which is substantially identical to burner 10 except that the burner 66 has a sloped impact surface 43 provided on the exterior of burner wall 20. The sloped surface 43 tapers inwardly toward the outer end 44. The longitudinal height 74 of the rearward end 76 of the sloped surface 43 can be in the range of from 0.05 to 20 inches or more and will more typically be in the range of from 2 to 5 inches. The longitudinal distance 77 from the rearward end 76 of the sloped surface 43 to the outer end 44 of the burner wall 20 of the burner 66 can be in the range of from 0.05 to 20 inches or more and will more typically be in the range of from 2 to 5 inches. The radial width 78 of the surrounding shoulder 44 at the forward end of the burner wall of the burner 66 can be in the range of from 0.05 to 15 inches or more and will more typically be in the range of from 0.2 to 2.25 inches.

Figure 11:
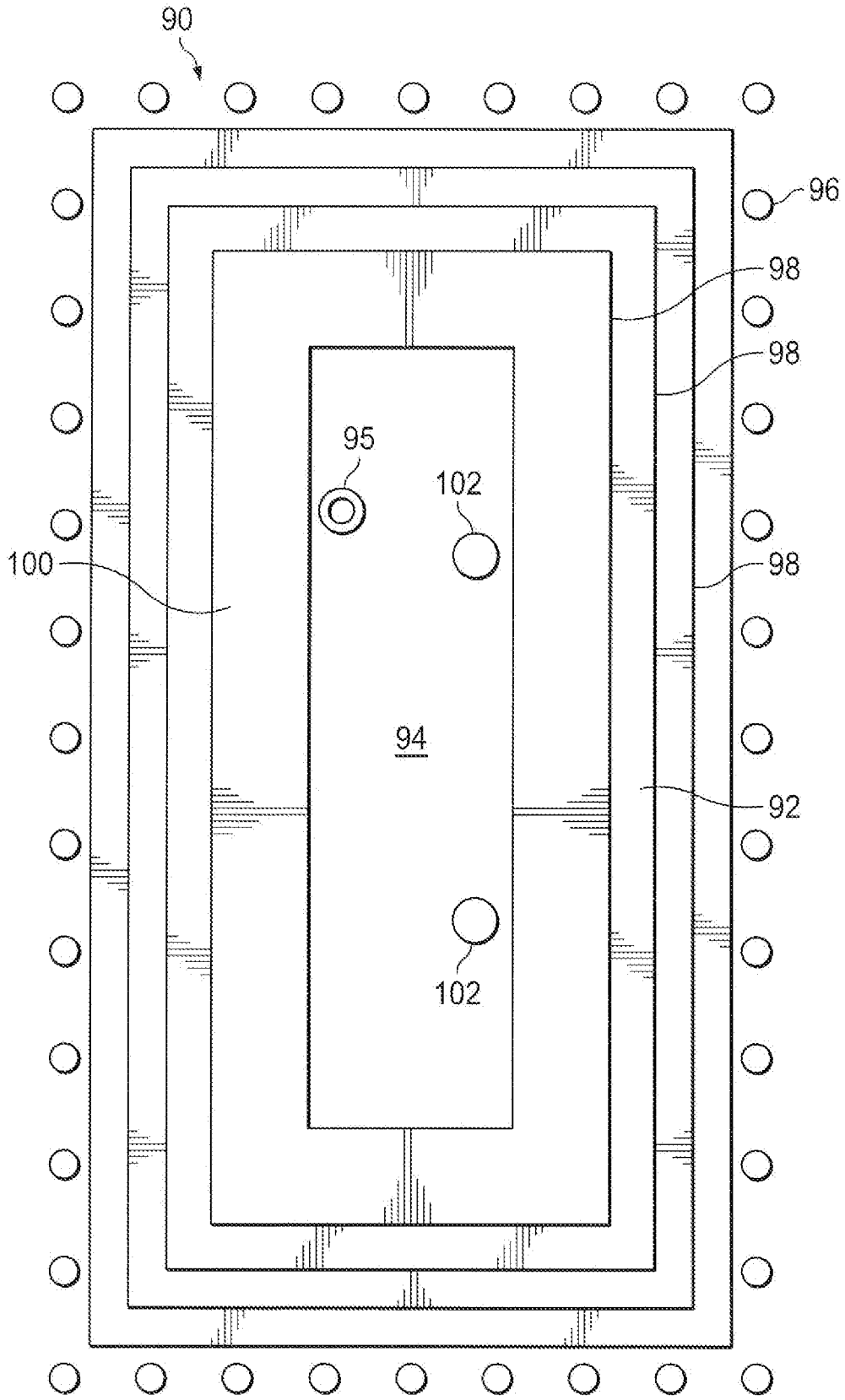
FIG. 11 is a plan view of an alternative embodiment 90 of the improved free-jet burner provided by the present invention.

FIG. 11 depicts another alternative embodiment 90 of inventive burner which is identical to burner 10 except that burner 90 is rectangular rather than circular in shape. FIG. 11 is a top view of the rectangular burner 90 wherein the burner wall 92 possesses a plurality of tiered, exterior impact ledges 98. A multiplicity of fuel ejection tips 96 are located outside the periphery of the burner wall 92 and a pair of auxiliary burners 102 are positioned in the interior flow passageway 94 as afore described. A burner pilot 95 can optionally be located within the interior passageway 94 to initiate combustion at the outer end 100 of the burner wall 92. The spacing of the fuel ejection tips 96, the size of the ejection ports, the spacing of the auxiliary tips 102, the dimensions of the impact ledges, etc. are preferably all the same as described above for burner 10.

Figure 12:
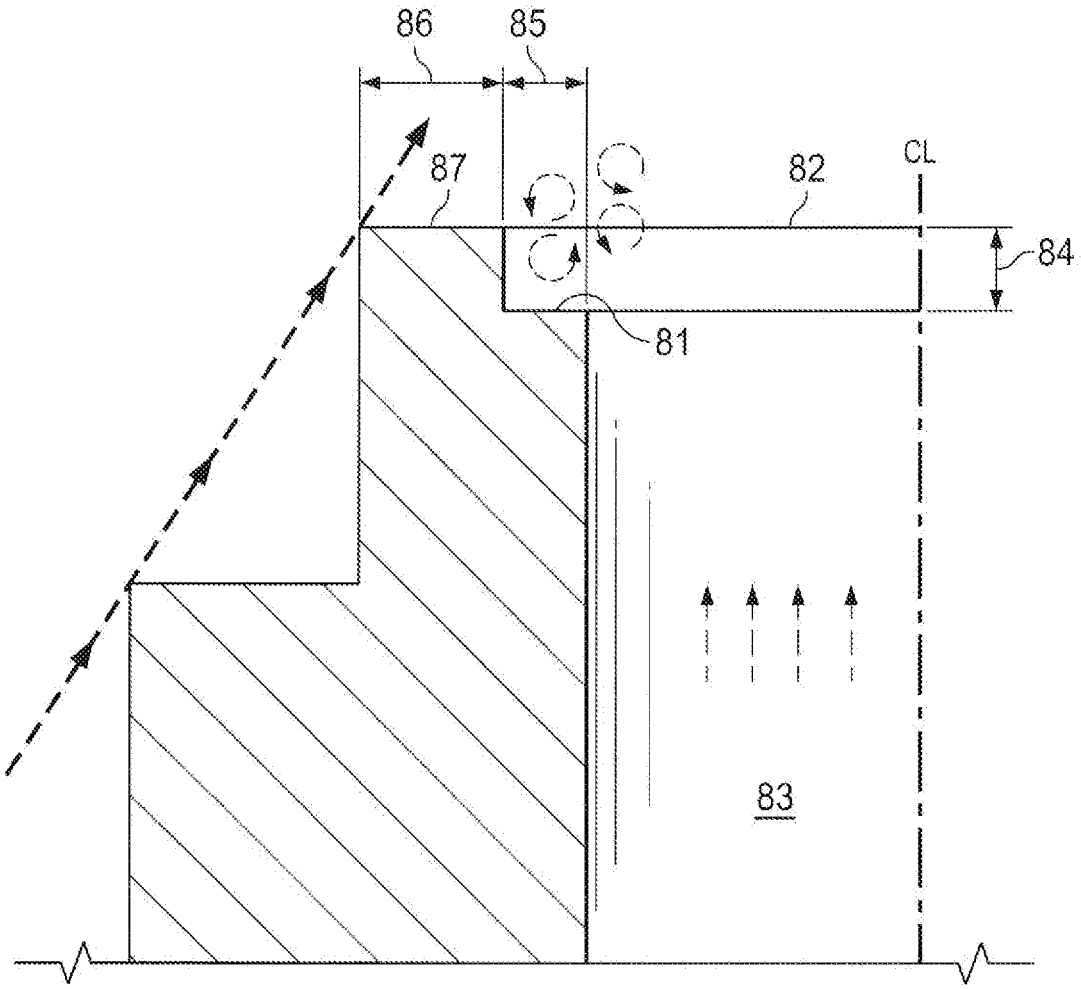
FIG. 12 is a cutaway partial side view of an alternative embodiment of the improved burner of the present invention having an interior ledge 81 formed in the outer end thereof.
Figure 13:
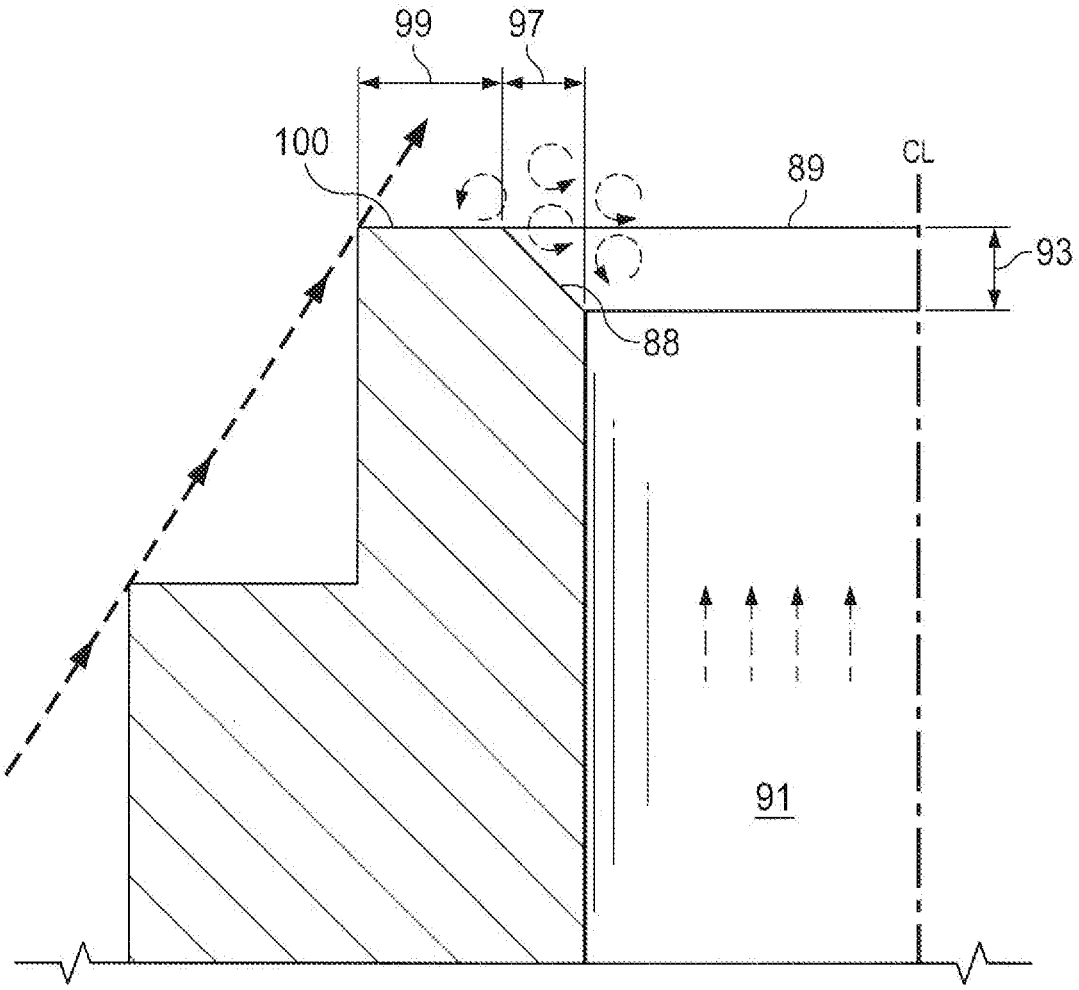
FIG. 13 is a cutaway partial side view of an alternative embodiment of the improved burner of the present invention having an interior beveled surface 88 formed in the outer end thereof.

FIGS. 12 and 13 depict structures of a type which can desirably be used in any of the embodiments described above to enhance the reduced pressure region at the outer end of the burner wall. The structure employed in FIG. 12 is an internal ledge 81 which forms a radial shoulder just inside of the outer end 82 of the internal passageway 83 for the air or other oxygen-containing gas. The longitudinal depth 84 of the ledge 81 can be in the range of from 0.05 to 5 inches or more and will more typically be in the range of from 0.25 to 1 inch. The radial width 85 of the ledge 81 can be in the range of from 0.05 to 5 inches or more and will more typically be in the range of from 0.2 to 1.5 inches. The radial width 86 of the surrounding shoulder 87 at the forward end 82 of the burner wall can be in the range of from 0.05 to 2 inches or more and will more typically be in the range of from 0.5 to 1.25 inches.

The structure employed in FIG. 13 is a sloped (beveled), outwardly diverging surface 88 formed just inside of the outer end 89 of the internal passageway 91 for the air or other oxygen-containing gas. The longitudinal depth 93 of the beveled surface can be in the range of from 0.05 to 5 inches or more and will more typically be in the range of from 0.25 to 1 inch. The radial width 97 of the beveled surface can be in the range of from 0.05 to 5 inches or more and will more typically be in the range of from 0.2 to 1.5 inches. The radial width 99 of the surrounding shoulder 101 at the forward end 89 of the burner wall can be in the range of from 0.05 to 2 inches or more and will more typically be in the range of from 0.5 to 1.25 inches.

The structures of FIGS. 12 and 13, or structures similar to those of FIGS. 12 and 13, further enhance the reduced pressure zone at the outlet end of the air flow passageway to assist in stabilizing the main burner flame by drawing the combustion flame to and holding the flame at the outer/forward end of the burner wall. The reduced pressure region also assists in mixing the combustion air or other oxygen-containing gas with the fuel streams and flue gas.

The burner 10 or other burner provided by the present invention can be a new burner or can be an existing prior art free-jet burner which is revamped to be resistant to plugging while maintaining low NOx emissions. The existing prior art burner will typically comprise: (i) a burner wall, (ii) an interior passageway of the burner wall for a flow of air or other oxygen-containing gas out of a forward end of the burner wall, and (iii) a series of x original ejectors which are positioned outside of and spaced around the interior passageway of the burner wall to deliver a fuel from the ejectors in free-jet flow streams outside of the burner wall either directly or indirectly to the main burner flame at and/or forwardly of the forward end of the burner wall In accordance with another aspect of the method of the present invention, the existing prior art free-jet burner is preferably revamped by: (a) increasing the tip-to-tip spacing of the ejectors by removing every other one of the original ejectors so that the number of remaining ejectors will be (i) one half of the number x of the original ejectors if the number x of the original ejectors is an even number or (ii) not more than $((x-1)/2)+1$ if the number of the original ejectors is an odd number; (b) replacing each of the remaining ejectors with a plugging resistant ejector having a large fuel ejection port with a flow area of at least 0.0068 $inch^2$; and (c) stabilizing the main burner flame by installing at least two auxiliary burner tips in the internal passageway of the burner wall which each direct an auxiliary tip flame onto the surrounding shoulder at the forward end of the burner wall or onto a ledge or other interior feature of the burner wall.

Concerning the original ejectors which are removed from the existing burner, pipe plugs will preferably be used to plug the locations in the exterior fuel supply manifold where the risers for these ejectors were connected. If the remaining ejectors comprise ejector tips positioned on the ends of fuel risers, the ejection ports will preferably be replaced by removing the original tips from the risers and installing new tips having larger ejection ports on the existing risers. The larger ports of the new tips will preferably have a flow area of at least 0.0068 $inch^2$ as mentioned above and will more preferably have a flow area of at least 0.012 $inch^2$.

The auxiliary burner tips can be any tips which are resistant to plugging and provide low $NO_x$ emissions. Each of the auxiliary burner tips will preferably be a sub-stoichiometric, staged air burner tip or a lean pre-mix burner tip. Each of the auxiliary burner tips will more preferably be a sub-stoichiometric staged air burner tip 102 as described above and shown in FIGS. 5-8. As also described above, the fuel supply line extending to the gas fuel spud 110 of each auxiliary burner tip 102 will preferably include an orifice union 136 with a flow orifice therein. The orifice will preferably have a flow area of at least 0.0068 $inch^2$, more preferably at least 0.012 $inch^2$, and the flow area of the fuel port 132 of the gas fuel spud 110 will preferably be larger than the flow area of the flow orifice.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A method of operating a burner for low $NO_x$ emissions, resistance to plugging, and enhanced stability, wherein (a) the burner comprises a burner wall having a forward end and an interior passageway through which a stream of air, or other oxygen-containing gas, flows out of the forward end of the burner wall, (b) the burner is operated in a heating system, and (c) the method comprises a step of ejecting a fuel from a series of ejectors in free-jet flow streams outside of the burner wall either directly or indirectly to a main burner flame at and/or forwardly of the forward end of the burner wall, wherein an improvement comprises:

ejecting the fuel from large fuel ejection ports in the ejectors having a flow area of at least 0.0068 $inch^2$;

recirculating a flue gas in the heating system through flow channels between the ejectors to the main burner flame, the ejectors having a wide tip-to-tip spacing between the ejectors of from 2 to 14 inches;

operating each of one or more auxiliary burner tips positioned in the interior passageway of the burner wall to direct an auxiliary tip flame onto the forward end of the burner wall or onto a ledge or other interior feature of the burner wall; and for each of the one or more auxiliary burner tips the improvement further comprises forming a fuel rich sub-stoichiometric combustion mixture in the auxiliary burner tip comprising a gas fuel supplied to the auxiliary burner tip, burning a first portion of the gas fuel supplied to the auxillary burner tip in a sub-stoichiometric combustion region of the auxiliary tip flame, and diverting the auxiliary tip flame laterally outward from the sub-stoichiometric combustion region into the stream of air, or other oxygen-containing gas, in the interior passageway of the burner wall, to form a fuel lean combustion region of the auxiliary tip flame in which a remaining portion of the gas fuel supplied to the auxiliary burner tip is burned.

2. The method of claim 1 wherein the improvement further comprises the flow area of the large fuel ejection ports of the ejectors being at least 0.012 $inch^2$.

3. The method of claim 2 wherein the improvement further comprises the wide tip-to-tip spacing between the ejectors being from 3.5 to 10 inches.

4. The method of claim 1 wherein the improvement further comprises the large fuel ejection ports being positioned longitudinally rearward and laterally outward with respect to the forward end of the burner wall.

5. The method of claim 1 wherein the improvement further comprises, for each of the one or more auxiliary burner tips, discharging the fuel rich sub-stoichiometric combustion mixture from a mixing chamber in the auxiliary burner tip through a stabilization ring at a forward longitudinal end of the mixing chamber to form a reduced pressure area at or outside of the forward longitudinal end of the mixing chamber which stabilizes the auxiliary tip flame of the auxiliary burner tip.

6. The method of claim 5 wherein the improvement further comprises each of the one or more auxiliary burner tips having a large fuel discharge port having a flow area of at least 0.012 $inch^2$ through which the gas fuel supplied to the auxiliary burner tip is delivered.

7. The method of claim 6 wherein the improvement further comprises, for each of the one or more auxiliary burner tips, delivering the gas fuel supplied to the auxiliary burner tip to the large fuel discharge port of the auxiliary burner tip through a flow orifice, the flow orifice having a flow area of at least 0.0068 $inch^2$, the flow area of the large fuel discharge port being larger than the flow area of the flow orifice, and the flow orifice being located and accessible outside of the heating system.

8. The method of claim 1 wherein the improvement further comprises, for each of the one or more auxiliary burner tips, the auxiliary tip flame is diverted laterally outward using a flame diverter having a lateral side opening.

9. A method of operating a burner for low $NO_x$ emissions, resistance to plugging, and enhanced stability, wherein (a) the burner comprises a burner wall having a forward end and an interior passageway through which a stream of air or other oxygen-containing gas flows out of the forward end of the burner wall, (b) the burner is operated in a heating system, and (c) the method comprises a step of ejecting a fuel from a series of ejectors in free-jet flow streams outside of the burner wall either directly or indirectly to a main burner flame at and/or forwardly of the forward end of the burner wall, wherein an improvement comprises:

ejecting the fuel from large fuel ejection ports in the ejectors having a flow area of at least 0.0068 $inch^2$;

recirculating a flue gas in the heating system through flow channels between the ejectors to the main burner flame, the ejectors having a wide tip-to-tip spacing between the ejectors of from 2 to 14 inches; and operating each of one or more auxiliary burner tips positioned in the interior passageway of the burner wall to direct an auxiliary tip flame onto the forward end of the burner wall or onto a ledge or other interior feature of the burner wall, each of the one or more auxiliary burner tips having a large fuel discharge port with a flow area of at least 0.012 $inch^2$; and the improvement further comprises for each of the one or more auxiliary burner tips a step (1) of discharging a gas fuel from the large fuel discharge port into a rearward longitudinal end of a mixing chamber of the auxiliary burner tip, the mixing chamber having a lateral base wall at the rearward longitudinal end of the mixing chamber and the lateral base wall having at least a central opening formed therethrough, a step (2) of using a flow momentum of the gas fuel discharged in step (1) to draw a sub-stoichiometric amount of the air, or other oxygen-containing gas, from the interior passageway of the burner through at least the central opening of the lateral base wall to form a fuel rich sub-stoichiometric mixture of the air, or other oxygen-containing gas, and the gas fuel in the mixing chamber, a step (3) of discharging the fuel rich sub-stoichiometric mixture of the air, or other oxygen-containing gas, and the gas fuel through a stabilization ring at a forward longitudinal end of the mixing chamber to form a reduced pressure area at or outside of the forward longitudinal end of the mixing chamber which stabilizes the auxiliary tip flame of the auxiliary burner tip, the auxiliary tip flame having an initial sub-stoichiometric combustion region in which a first portion of the gas fuel of the fuel rich sub-stoichiometric mixture of the air, or other oxygen-containing gas, and the gas fuel is burned, and a step (4) of diverting the auxiliary tip flame laterally outward, into the stream of air, or other oxygen-containing gas, in the interior passageway of the burner wall, to form a fuel lean combustion region in which a remaining portion of the gas fuel is combusted.

10. A method of operating a burner for low $NO_x$ emissions, resistance to plugging, and enhanced stability, wherein (a) the burner comprises a burner wall having a forward end and an interior passageway through which a stream of air or other oxygen-containing gas flows out of the forward end of the burner wall, (b) the burner is operated in a heating system, and (c) the method comprises a step of ejecting a fuel from a series of ejectors in free-jet flow streams outside of the burner wall either directly or indirectly to a main burner flame at and/or forwardly of the forward end of the burner wall, wherein an improvement comprises:

operating each of one or more auxiliary burner tips positioned in the interior passageway of the burner wall to direct an auxiliary tip flame onto the forward end of the burner wall or onto a ledge or other interior feature of the burner wall and for each of the one or more auxiliary burner tips forming, in a mixing chamber of the auxiliary burner tip, a fuel rich sub-stoichiometric combustion mixture comprising a gas fuel supplied to the auxiliary burner tip and discharging the fuel rich sub-stoichiometric combustion mixture from the mixing chamber through a stabilization ring at a forward longitudinal end of the mixing chamber to form a reduced pressure area at or outside of the forward longitudinal end of the mixing chamber which stabilizes the auxiliary tip flame of the auxiliary burner tip.

11. The method of claim 10 wherein the improvement further comprises for each of the one or more auxiliary burner tips:

burning a first portion of the gas fuel supplied to the auxiliary burner tip in a sub-stoichiometric combustion region of the auxiliary tip flame and diverting the auxiliary tip flame laterally outward from the sub-stoichiometric combustion region into the stream of air, or other oxygen-containing gas, in the interior passageway of the burner wall, to form a fuel lean combustion region of the auxiliary tip flame in which a remaining portion of the gas fuel supplied to the auxiliary burner tip is burned.

12. A method of operating a burner for low $NO_x$ emissions, resistance to plugging, and enhanced stability, wherein (a) the burner comprises a burner wall having a forward end and an interior passageway through which a stream of air, or other oxygen-containing gas, flows out of the forward end of the burner wall, (b) the burner is operated in a heating system, and (c) the method comprises a step of ejecting a fuel from a series of ejectors in free-jet flow streams outside of the burner wall either directly or indirectly to a main burner flame at and/or forwardly of the forward end of the burner wall, wherein an improvement comprises:

operating each of one or more auxiliary burner tips positioned in the interior passageway of the burner wall to direct an auxiliary tip flame onto the forward end of the burner wall or onto a ledge or other interior feature of the burner wall and for each of the one or more auxiliary burner tips the improvement further comprises forming a fuel rich sub-stoichiometric combustion mixture in the auxiliary burner tip comprising a gas fuel supplied to the auxiliary burner tip, burning a first portion of the gas fuel supplied to the auxiliary burner tip in a sub-stoichiometric combustion region of the auxiliary tip flame, and diverting the auxiliary tip flame laterally outward from the sub-stoichiometric combustion region into the stream of air, or other oxygen-containing gas, in the interior passageway of the burner wall, to form a fuel lean combustion region of the auxiliary tip flame in which a remaining portion of the gas fuel supplied to the auxiliary burner tip is burned.

13. The method of claim 12 wherein the improvement further comprises, for each of the one or more auxiliary burner tips, the auxiliary tip flame is diverted laterally outward using a flame diverter having a lateral side opening.

14. A method of operating a burner for low $NO_x$ emissions, resistance to plugging, and enhanced stability, wherein (a) the burner comprises a burner wall having a forward end and an interior passageway through which a stream of air, or other oxygen-containing gas, flows out of the forward end of the burner wall, (b) the burner is operated in a heating system, and (c) the method comprises a step of ejecting a fuel from a series of ejectors in free-jet flow streams outside of the burner wall either directly or indirectly to a main burner flame at and/or forwardly of the forward end of the burner wall, wherein an improvement comprises:

operating each of one or more auxiliary burner tips positioned in the interior passageway of the burner wall to direct an auxiliary tip flame onto the forward end of the burner wall or onto a ledge or other interior feature of the burner wall, each of the one or more auxiliary burner tips having a large fuel discharge port with a flow area of at least 0.012 $inch^2$ and for each of the one or more auxiliary burner tips, delivering a gas fuel to the large fuel discharge port of the auxiliary burner tip through a flow orifice, the flow orifice having a flow area of at least 0.0068 $inch^2$, the flow area of the large fuel discharge port being larger than the flow area of the flow orifice, and the flow orifice being positioned and accessible outside of the heating system.

* * * * *